US005168600A

United States Patent [19]

Huang

[11] Patent Number: 5,168,600

[45] Date of Patent: Dec. 8, 1992

[54] TOOL HANDLE WITH SHOW BILL WINDOW

[76] Inventor: Shu-Nu Huang, No. 88, Lane 412, Chen Hsing Rd., Taichung, Taiwan

[21] Appl. No.: 838,347

[22] Filed: Feb. 20, 1992

[51] Int. Cl.[5] ..... G09F 3/18

[52] U.S. Cl. ..... 16/110.005; 16/111 R; 40/660

[58] Field of Search ..... 40/660, 661, 650, DIG. 913; 16/110.5, 111 R, DIG. 12, DIG. 19; 81/489, DIG. 5

[56] References Cited

U.S. PATENT DOCUMENTS

| | | | |
|---|---|---|---|
| 2,127,163 | 8/1938 | Davis | 40/660 |
| 2,173,942 | 9/1939 | Hiatt et al. | 40/660 |
| 2,175,481 | 10/1939 | Padulo | 40/660 |
| 2,176,698 | 10/1939 | Albrecht | 40/660 |
| 2,187,192 | 1/1940 | Albrecht | 40/661 |

*Primary Examiner*—John Sipos
*Assistant Examiner*—Carmine Cuda
*Attorney, Agent, or Firm*—Bacon & Thomas

[57] ABSTRACT

A tool handle comprised of a hollow, transparent handle body defining a chamber therein inserted with a plug, the handle body having a plurality of raised stripes longitudinally disposed around the outer wall surface thereof for positive grip, and a plurality of retaining notches internally disposed around a top opening thereof, the plug comprising an elongated rod vertically extending downwards from a spherical head and inserted through the top opening into the chamber, the elongated rod having a bottom hole for holding the tool bit inserted into a bottom hole on the handle body, a plurality of projecting strips respectively engaged in the retaining notches, and a peripheral surface for marking advertising matters or attaching an advertising label for showing through the transparent handle body, the spherical head being stopped above the top opening and having a peripheral wall surface disposed flush with a peripheral wall surface of the handle body for comfortable grip.

1 Claim, 2 Drawing Sheets

TOOL HANDLE WITH SHOW BILL WINDOW

BACKGROUND OF THE INVENTION

The present invention relates to a handle for a hand tool, and more particularly, the present invention relates to a tool handle which is comprised of a hollow, transparent handle body and a plug. The plug has an elongated rod inserted into a chamber inside the handle body with the peripheral wall surface thereof marked with advertising matters or adhered with an advertising label for showing through the transparent handle body.

A handle tool generally has a handle for positive and comfortable grip. For advertising purposes, a hand tool manufacturer may mark the handle of a hand tool with advertising matters or adhere it with a small label. However, the label or advertising matters on the outer wall surface of a handle may be rubbed off easily during the use of the hand tool. If embossed advertising matters are directly formed on the outer wall surface of a handle, they may make grip uncomfortable.

SUMMARY OF THE INVENTION

The present invention has been accomplished under the aforesaid circumstances. It is therefore an object of the present invention to provide a tool handle which has a show board surface at the inside for marking advertising matters or attaching an advertising label. It is another object of the present invention to provide a tool handle which has means for positive and comfortable grip.

According to the present invention, there is provided a tool handle which is generally comprised of a hollow, transparent handle body and a plug. The handle body defines a chamber therein for inserting the plug through a top opening thereof, a plurality of raised stripes longitudinally disposed around the outer wall surface thereof for positive grip, and a plurality of retaining notches internally disposed around the top opening thereof. The plug comprises an elongated rod vertically extending downwards from a spherical head and inserted through the top opening into the chamber of the handle body, which elongated rod has a bottom hole for holding the tool bit inserted into a bottom hole on the handle body, a plurality of projecting strips respectively engaged in the retaining notches on the handle body for positioning, and a peripheral surface for marking advertising matters or attaching an advertising label for showing through the transparent handle body. The spherical head of the plug is stopped above the top opening and has a peripheral wall surface disposed flush with the peripheral wall surface of the handle body for comfortable grip.

DETAILED DESCRIPTION OF THE PREFERRED EMBODIMENT

Figure 1:
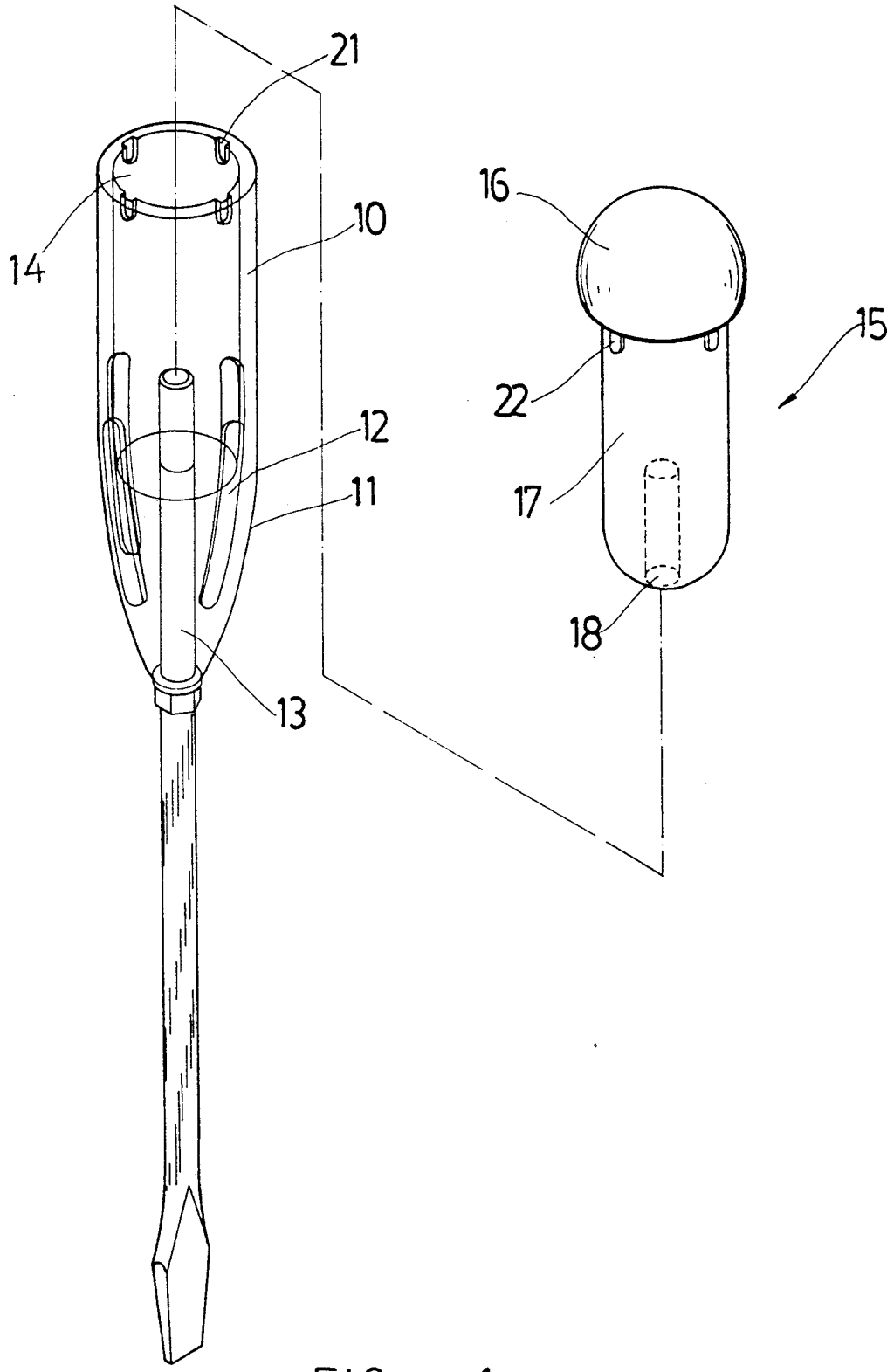
FIG. 1 is an exploded view of a tool handle embodying the present invention.
Figure 2:
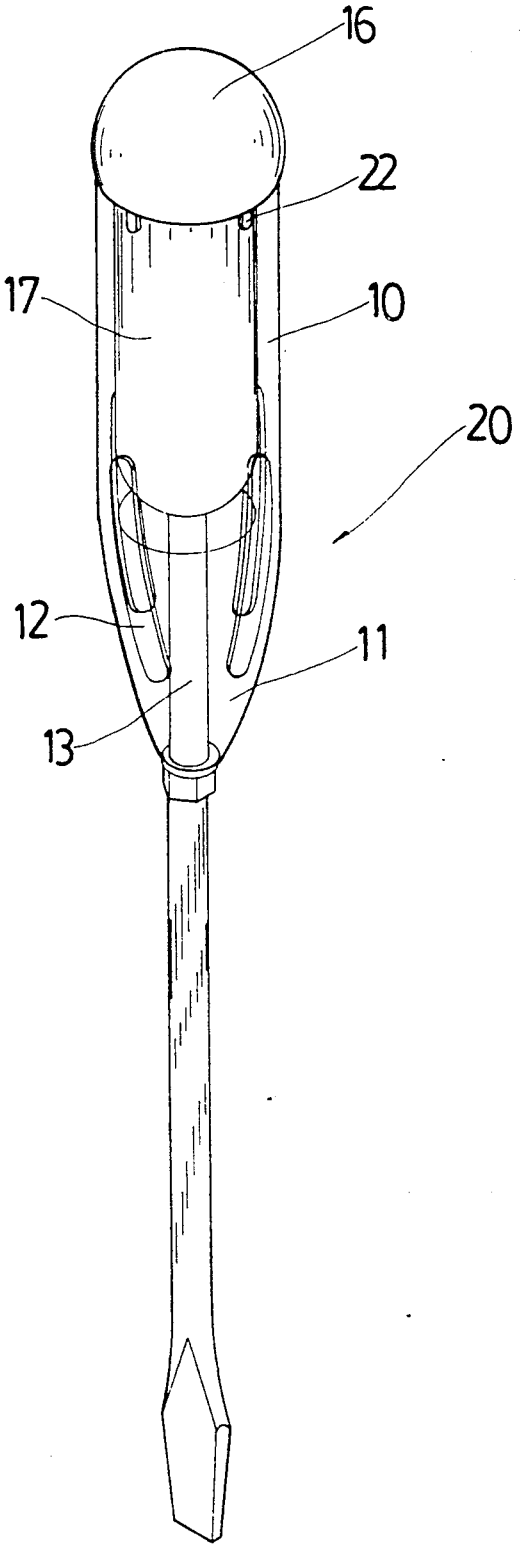
FIG. 2 is a perspective assembly view thereof.

Referring to FIGS. 1 and 2, therein illustrated is a screw driver 20 as constructed in accordance with the present invention. The handle of the screw driver 20 is generally comprised of a handle body 10 and a plug 15.

The handle body 10 of the tool handle is made from a transparent plastic plastic material through the process of injection molding, in the shape of a hollow cylinder, defining therein a cylindrical chamber 14 for inserting the plug 15, and having a tapered portion 11 at the bottom end thereof (which has a hole, not shown, on the bottom end thereof for inserting a tool bit 13), a plurality of raised stripes 12 longitudinally disposed around the outer wall surface thereof for positive grip, and a plurality of retaining notches 21 internally disposed around the top edge thereof for fastening the plug 15. The plug 15 is comprised of an elongated rod 17, and a spherical head 16 at the top of the rod 17. The spherical head 16 has an outer diameter fitting the handle body 10. The elongated rod 17 is made in size and shape tightly fitting the cylindrical chamber 14. The elongated rod 17 of the plug 15 comprises a plurality of projecting strips 22 around the peripheral surface thereof adjacent to the spherical head 16 and at locations corresponding to the retaining notches 21 on the handle body 10, and a cylindrical bottom hole 18 on the bottom edge thereof for fastening the bit 13 which is inserted through the hole (not shown) on the tapered portion 11 of the handle body 10. By inserting the elongated rod 17 of the plug 15 into the cylindrical chamber 14 with the projecting strips 22 respectively engaged into the retaining notches 21, permitting the tool bit 13 to be inserted into the cylindrical hole 18, the plug 15 becomes firmly secured in the handle body 10 with the outer wall surface of the spherical head 16 disposed flush with the outer wall surface of the handle body 10 (see FIG. 2).

By means of the aforesaid arrangement, marks, patterns and descriptive or advertising words can be made on the outer wall surface of the enlongated rod 17 of the plug for showing. An advertising label may be directly adhered to the outer wall surface of the elongated rod 17 for showing through the transparent handle body 10. Therefore, the transparent handle body 10 simultaneously serves as an advertising show window. Further, the design of the spherical head 16 of the plug 15 makes the screw driver 20 comfortable to hold; the design of the raised stripes 12 on the handle body 10 ensures positive grip.

I claim:

1. A handle for a hand tool, the improvement comprising a hollow transparent handle body for holding a tool bit, and a plug inserted in said handle body at the top, said handle body having a chamber therein, a top opening above said chamber, a plurality of raised stripes longitudinally disposed around an outer wall surface thereof, and a plurality of retaining notches around said top opening, said plug comprising an elongated rod vertically extending downwards from a spherical head and inserted through said top opening into said chamber, said elongated rod having a plurality of projecting strips around a peripheral top edge thereof respectively engaged in said retaining notches, a peripheral surface for marking advertising matter for showing through said transparent handle body, and a bottom hole for inserting said tool bit, said spherical head being stopped above said top opening and having a peripheral wall surface disposed flush with the outer wall surface of said handle body.

* * * * *